United States Patent [19]

Oda et al.

[11] 4,302,322

[45] Nov. 24, 1981

[54] LOW HYDROGEN OVERVOLTAGE ELECTRODE

[75] Inventors: Yoshio Oda; Hiroshi Otouma; Eiji Endoh, all of Yokohama, Japan

[73] Assignee: Asahi Glass Company, Ltd., Tokyo, Japan

[21] Appl. No.: 142,377

[22] Filed: Apr. 21, 1980

Related U.S. Application Data

[63] Continuation-in-part of Ser. No. 10,257, Feb. 6, 1979, abandoned.

[30] Foreign Application Priority Data

Feb. 24, 1978 [JP] Japan ..... 53-19925

[51] Int. Cl.[3] ..... C25B 11/04; C25D 15/00

[52] U.S. Cl. ..... 204/293; 204/16

[58] Field of Search ..... 204/16, 280, 292, 293

[56] References Cited

U.S. PATENT DOCUMENTS

| | | | |
|---|---|---|---|
| 3,790,454 | 2/1974 | Henderson | 204/49 |
| 3,884,772 | 5/1975 | Shiga | 204/16 |
| 4,024,044 | 5/1977 | Brannan | 204/242 |
| 4,170,536 | 10/1979 | Kawasaki | 204/35 R |

FOREIGN PATENT DOCUMENTS

| | | | |
|---|---|---|---|
| 1952915 | 4/1971 | Fed. Rep. of Germany | 204/16 |
| 2449603 | 5/1976 | Fed. Rep. of Germany | 204/16 |
| 949837 | 2/1964 | United Kingdom | 204/16 |
| 1070343 | 6/1967 | United Kingdom | 204/16 |
| 1148865 | 4/1969 | United Kingdom | 204/16 |
| 1218179 | 1/1971 | United Kingdom | 204/16 |
| 1347184 | 2/1974 | United Kingdom | 204/16 |
| 324301 | 6/1972 | U.S.S.R. | 204/16 |

OTHER PUBLICATIONS

Modern Electroplating, Edited by F. A. Lowenheim,, 1974, pp. 287–289, 313–315, 335.

J. of the Electrochemical Society, vol. 109, No. 4, Apr., 1962, pp. 292–295.

*Primary Examiner*—T. M. Tufariello

*Attorney, Agent, or Firm*—Oblon, Fisher, Spivak, McClelland & Maier

[57] ABSTRACT

This invention presents low hydrogen overvoltage electrode which comprises a plated metal layer of nickel or cobalt which contains partially exposed particles made of nickel or cobalt on an electrode substrate, the surface of which particles does not contain oxygen, which concentration is more than 150 ppm, and process for preparing such electrode, which comprises codepositing electrically and electrophoretically nickel or cobalt particles with nickel or cobalt from a dispersed solution which contains $Cl^-$ of the concentration of not less than 30 $gCl^-/l$ solution.

9 Claims, 4 Drawing Figures

LOW HYDROGEN OVERVOLTAGE ELECTRODE

CROSS REFERENCE TO RELATED APPLICATIONS

This application is a continuation-in-part of application Ser. No. 010,257, filed Feb. 6, 1979, now abandoned.

BACKGROUND OF THE INVENTION

1. Field of the Invention

The present invention relates to an electrode with low hydrogen overvoltage which is used in an electrolysis of an aqueous solution and the process for preparing said electrode.

2. Description of the Prior Arts

Various anticorrosive electrodes have been used in electrolysis of aqueous solution to obtain an electrolyzed products such as electrolysis of an aqueous solution of an alkali metal chloride to obtain an alkali metal hydroxide and chlorine.

When an overvoltage of the electrode used in an electrolysis of an aqueous solution such as an aqueous solution of alkali metal chloride or water is lowered, the electric power consumption can be reduced and the electrolyzed product can be obtained at low cost.

In order to reduce a chlorine overvoltage of an anode, various studies have been made on the materials of the substrate and the treatments. Some of them have been practically employed.

It has been needed to use an electrode having a low hydrogen overvoltage and an anticorrosive characteristic since the diaphragm method for an electrolysis using a diaphragm has been developed.

In the conventional electrolysis of an aqueous solution of an alkali metal chloride using an asbestos diaphragm , iron mesh has been used as a cathode.

It has been proposed to treat a surface of an iron substrate by a sand blast treatment in order to reduce a hydrogen overvoltage of the iron substrate (for example, Surface Treatment Handbook Page 541 to 542 (Sangyotosho) by Sakae Tajima). However, the asbestos diaphragm method has disadvantage of a low concentration of sodium hydroxide as about 10 to 13 wt. % and a contamination of sodium chloride in an aqueous solution of sodium hydroxide. Accordingly, the electrolysis of an aqueous solution of an alkali metal chloride using an ion exchange membrane as a diaphragm has been studied, developed and practically used.

In accordance with the latter method, an aqueous solution of sodium hydroxide having high concentration of 25 to 40 wt. % may be obtained. When the iron substrate is used as a cathode in the electrolysis, the iron substrate is broken by stress corrosion cracking or a part of the iron substrate is dissolved in a catholyte because of high concentration of sodium hydroxide and high temperature such as 80° C. to 120° C. in an electrolysis. British Pat. No. 1,148,865 discloses that low overvoltage electrode is obtained with codeposition of metal particles, for example, Raney nickel and nickel from suspension which comprises metal particles suspended in the same metal containing solution. The similar disclosure is found in U.S. Pat. No. 4,170,536. However, the electrolytic characteristics of these electrodes is not satisfactory for use in practice. Namely, such electrode is poor in activity and the adhesion of the particles to the bonding metal is not enough so a characteristics deteriorates during a short period. This is because, in these prior art, said solution is so called Watt bath containing low concentration of chlorine ion. So, these electrodes contain particles, the oxygen content of which is very large, resulting low activity and low adhesion strength of said particles.

SUMMARY OF THE INVENTION

It is an object of the present invention to provide an electrode which is anticorrosive to an alkali metal hydroxide and which reduces effectively hydrogen overvoltage for a long time in an electrolysis of alkali metal halide solution or water.

The electrode according to the invention is obtained by codepositing nickel or cobalt alloy particles and nickel or cobalt electrolytically and electrophoretically from the dispersed solution which comprises nickel or cobalt alloy particles dispersed in a solution containing nickel or cobalt ions and chlorine ions of the concentration of not less than 30 g $Cl^-$/l solution and the resulting electrode contains metal particles, which do not contain oxygen of more than 150 ppm, and give good activity and good adhesion.

DETAILED DESCRIPTION OF PREFERRED EMBODIMENTS

Figure 1:
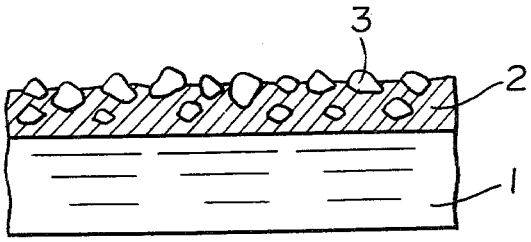
FIG. 1 is a cross-sectional view of one embodiment of the present electrode.

On the surface of the electrode of the present invention, many particles of Ni or Co are bonded to form porous layer.

The electrode of the present invention comprises many exposed particles of Ni or Co having low hydrogen overvoltage on the surface of the electrode to form a fine porous condition of the surface, whereby activity of the electrode is high and the hydrogen overvoltage of the electrode can be effectively reduced by synergytic effect and so as to keep above characteristics such particles has to hold oxygen of the concentration of not more than a limited value.

The exposed particles of Ni or Co are firmly bonded in the metal layer formed on the electrode substrate whereby they are not deteriorated to prolong remarkably the maintenance of the low hydrogen overvoltage.

The electrode substrate can be made of suitable electric conductive metal such as Ti, Zr, Fe, Ni, V, Mo, Cu, Ag, Mn, platinum group metals, graphite and Cr and alloys thereof and preferably Fe and Fe-alloys (Fe-Ni alloy, Fe-Cr alloy and Fe-Ni-Cr alloy), Ni and Ni-alloys (Ni-Cu alloy and Ni-Cr alloy), Cu and Cu-alloys, and especially Fe, Cu, Ni, Fe-Ni alloys and Fe-Ni-Cr-alloys.

The structure of the electrode substrate can have a size suitable for the electrode.

The shape of the electrode can be plate, porous and net (expanded metal) or parallel screen shape which can be flat, curved or cylindrical.

The exposed particles of Ni or Co can be made of the metal itself or an alloy having the metal as main component or a composite of the metal or the alloy.

When the composite or the alloy having said metal as the main component is used, a metal which does not substantially adversely affect to reduce the hydrogen overvoltage such as Al, Zn, Mg, Si, Sb or Sn though it is depending upon a content of the additional metal.

The average particle size of the particles is usually in a range of 0.1 to 100μ though it is depending upon a dispersibility of the particles. From the viewpoint of porosity on the surface of the electrode, the average particle size is preferably in a range of 0.9 to 50μ especially 1 to 30μ.

The particles are preferably porous on their surfaces so as to give lower hydrogen overvoltage. Most important characteristics of the particles is that said particles must not contain much oxygen, i.e. it is necessary that said particles do not contain oxygen, the amount of which exceeds 150 ppm, preferably 100 ppm.

Usually, nickel alloy particle (i.e. Raney nickel alloy) or cobalt alloy particle (i.e. Raney cobalt alloy) contains oxygen in the concentration ranging from 20 ppm to 500 ppm, which difference arises from the origin, particle size or particle size distribution of said particle. And, larger amount of such oxygen is likely to locate in its surface layer because said particle is more easily oxidized in its surface layer than in its interior during its storage or transportation etc.

The inventors found that if there exists much oxygen on the particle surface, the surface is in the passive state, so the activity is very little and moreover the passive state intervenes the adhesion of the particles to the bonding metal. As the result, the initial activity of the electrode is low and the activity deteriorates soon because of e.g. falling off the particles from the surface.

The terminology of porous on their surfaces means to be porous on the surface exposed over the metal layer and does not mean to be porous on all of the surfaces of the particles.

It is preferable to be higher porosity, however excessive porosity causes low mechanical strength and accordingly, the porosity is preferably in a range of 35 to 85% especially 50 to 80%.

The porosity is measured by the conventional water substituting method.

Various methods have been employed for forming the porous surface such as a method of removing metals other than Ni and Co from an alloy having Ni or Co as the main component to form the porous surface; a method of converting Ni or Co into carbonyl compound thereof and decomposing thermally the carbonyl compound to form the porous surface; a method of decomposing thermally an organic acid salt of Ni or Co to form the porous surface; and a method of heating an oxide of Ni or Co in hydrogen reducing atmosphere to form the porous surface.

From the viewpoint of a possibility, it is preferable to employ the method of removing metals other than Ni and Co from an alloy having Ni or Co as the main component. In such method, the particles are made of an alloy comprising the first group metal of Ni and Co and the second group metal selected from the group consisting of Al, Zn, Mg, Si, Sb and Sn and at least part of the second type metal component is removed from the alloy.

Examples of such alloys include Ni-Al alloys, Ni-Zn alloys, Ni-Mg alloys and Ni-Sn alloys, Co-Al alloys, Co-Zn alloys, Co-Mg alloys, Co-Sn alloys.

From the viewpoint of each availability, it is preferable to use Ni-Al alloys or Co-Al alloys such as unleached Raney nickel alloy or Raney cobalt alloy, especially Ni-Al alloy such as Raney nickel.

The metals of the metal layer for bonding the particles are metals having high alkali resistance and bonding firmly the particles and preferably selected from the group consisting of Ni and Co especially the metal same with the metal as the main component of the particles.

The thickness of the metal layer is ranging 20 to 200μ preferably 25 to 150μ, especially 30 to 100μ since the particles are bonded in the metal layer on the electrode substrate under burying partially in the metal layer.

FIG. 1 shows a sectional view of the surface of the electrode of the present invention to be easily understood.

As shown in FIG. 1, the metal layer (2) is formed on an electrode substrate (1) and particles (3) are firmly bonded in the metal layer so as to expose parts of the particles above the metal layer.

A ratio of the particles in the metal layer (2) is ranging 15 to 80 wt. %, preferably 25 to 60 wt. %.

It is also preferable to form a middle layer made of a metal selected from the group consisting of Ni, Co and Cu between the electrode substrate and the metal layer containing the particles whereby a durability of the electrode is improved.

Such middle layer can be made of the same or different metal of the metal layer and is preferably made of the same metal from the viewpoint of the bonding strength to the metal layer.

A thickness of the middle layer is ranging 5 to 100μ preferably 20 to 80° especially 30 to 50μ.

Figure 2:
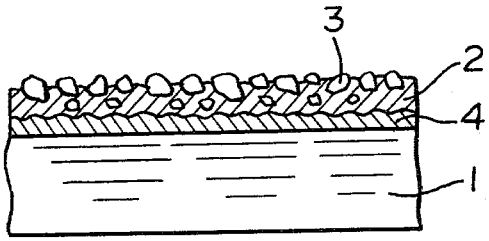
FIG. 2 is a cross-sectional view of another embodiment of the present electrode.

FIG. 2 is a sectional view of an electrode having the middle layer as the schematic view to be easily understood.

In FIG. 2, the electrode comprises the electrode substrate (1), the middle layer (4), the metal layer (2) containing particles and the particles (3).

Many particles are exposed on the surface of the electrode in macro but the surface of the particles is porous in micro.

The degree of the porosity relates to the reduction of hydrogen overvoltage and is satisfactory more than 1000 $\mu F/cm^2$ as an electrical double layer capacity (a value of a double-layer capacity) and preferably more than 2000 $\mu F/cm^2$ especially more than 5000 $\mu F/cm^2$.

The electrical double layer capacity is electrostatic capacity of electric double layer formed by distributing relatively positive and negative ions with short distance near the surface of the electrode when dipping the electrode in an electrolyte and it is measured as differential capacity.

The capacity is increased depending upon increasing specific surface of the electrode. Thus, the electrical double layer capacity of the surface of the electrode is increased depending upon increasing an porosity of the surface and a surface area of the electrode. The electrochemically effective surface area of the electrode that is the porosity of the surface of the electrode can be considered by the electrical double layer capacity.

The electrical double layer capacity is varied depending upon temperature at the measurement and the kind and concentration of the electrolyte, and on the potential and the electrical double layer capacity in the specification means values measured by the following method.

If the electrode of this invention is used for an electrolysis of alkali halide solution, the electrode can be used without the following treatment in caustic soda solution. But, if for an electrolysis of water, the electrode of this invention has better be treated as follows before use.

A test piece (electrode) and a platinum electrode having platinum black coat (platinized platinum plate) having a specific area of about 100 times of the area of the test piece were immersed in an aqueous solution of 40 wt. % of NaOH at 25° C., forming a pair of electrodes. The cell-impedance under the condition was measured with Kohlarausch bridge and an electrical double layer capacity for the test piece was calculated.

To get above-mentioned electrode, the dispersion coating method is preferable since the particles can be bonded in the metal layer in the present invention.

In the dispersion coating method, the particles are suspended in the plating bath in which electroplating is carried out and they are codeposited on the substrate with the plated metal.

In order to maintain the dispersing conditions, various methods such as a mechanical stirring method, an air mixing method, a liquid circulating method, an ultrasonic vibrating method and a fluidized bed method can be employed.

When the dispersion coating method is employed by using conductive particles, the electrodeposited material is dendritic and has low strength as disclosed in R. Bazzard, Trans, Inst. Metal Finishing, 1972, 50 63; J. Foster et al, ibid, 1976, 54 178).

It has been found, in accordance with detailed studies on the dispersion coating method, that the electrodeposited material is dendritic and has relatively low strength when a stirring is not vigorous whereas the electrodeposited material is not substantially dendritic and has high strength and hydrogen overvoltage is low enough when a stirring is vigorous. When the stirring is too vigorous, an amount of the codeposition of the particles decrease to form a smooth electrodeposition and the hydrogen overvoltage is high though the strength of the metal layer and the bonding strength are high enough.

It has been found that the hydrogen overvoltage, strength and shape of the electrodeposition in the dispersion coating method are highly related with a condition of the dispersion.

In a preparation of an industrial size electrode, if non-uniform codeposition is partially formed, hydrogen overvoltage is low to increase current at parts of much deposition whereas hydrogen overvoltage is high to decrease current at parts of less codeposition. The current line distribution is highly disturbed disadvantageously.

It is important to codeposit uniformly that is to carry out a dispersion coating under a uniform stirring condition.

Various uniform codeposition method have been studied. As the result, it has been found that a dispersion coating method of coating under vertically vibrating a perforated plate at a lower part in a plating vessel is preferable. It has been found that a method of stirring uniformly the plating bath by injecting an inert gas such as $N_2$ gas or a reducing gas such as $H_2$ gas into a plating vessel is further preferable.

As the result of the studies on a method of stirring uniformly a plating bath by recycling it, it has been found that a plating method by flowing a plating solution having dispersed particles from the lower part to the upper part at the rate of 5–300 cm/sec at a coated plate disposed between a pair of anodes is also preferable. In such case, it is further preferable to stir the bath under injecting an inert gas or a reducing gas.

When a nickel layer is formed as a metal layer, it is possible to use a plating bath such as nickel chloride bath, nickel chloride-nickel sulfate bath, nickel chloride-nickel acetate bath, nickel chloride-iron salts bath, nickel chloride-molybdenum salts bath and nickel chloride-tungsten salts bath.

All of above-mentioned bath contains chlorine ions which concentration is not less than 30 g $Cl^-$/l solution.

When a cobalt layer is formed as a metal layer, it is possible to use a plating bath such as cobalt chloride bath, cobalt chloride-cobalt sulfate bath, cobalt chloride-cobalt acetate bath, cobalt alloy bath, cobalt chloride-iron salts bath, cobalt chloride-molybdenum salts bath and cobalt chloride-tungsten salts bath.

All of above-mentioned bath contains chlorine ions which concentration is not less than 30 g $Cl^-$/l solution.

If the solution does not contain the above-mentioned amount of chlorine ions, the following drawbacks occur.

Watts bath, often used as a conventional plating bath, has generally a composition of $NiSO_4.7H_2O$: 300 g/liter, $NiCl_2.6H_2O$: 45 g/liter, $H_3BO_3$ 30 g/liter, i.e. a chlorine ion concentration of 13.5 g $Cl^-$/l solution. And if it is used as a dispersing solution, the surface of the nickel alloy particles dispersed therein can not be cleaned sufficiently by chlorine ions, namely, the passive state existing originally in the surface layer can not be removed sufficiently and there remains oxygen of more than 150 ppm, more usually 300 ppm both on and in said particle, mainly in the particle surface layer such particles may be considered to be non-conductive ceramic or oxide. Accordingly, such passive state containing oxygen does not lower hydrogen overvoltage and intervenes an adherence of the particles. Furthermore, the amount of the particles deposited is not large, and so as for the desired amount of particles to be deposited, the concentration of the particles in the dispersion solution should be kept high. That is, from the standpoint of a performance as an electrode having low hydrogen overvoltage for an alkali halide electrolysis, the content of the nickel alloy particles in the codeposited layer should be at least 15 wt. % preferably 25 wt. % and in this case the concentration of the nickel alloy particles in the solution has to be more than 50 g/l solution, preferably more than 100 g/l solution.

Even though the concentration of the nickel alloy particles in the solution is sufficiently high in case of Watts bath, resulting electrode has high hydrogen overvoltage even at the initial stage and easily deteriorates in hydrogen overvoltage in an electrolysis of alkali halide solution.

Moreover, in Watts bath, plating procedure must be carried out soon after Watts bath containing nickel alloy particle is prepared, because Watts bath containing nickel alloy particles can be used only several hours after its preparation, and after more than several hours after its preparation, the amount of nickel alloy particle codeposited onto the substrate is very small unless the greater part of the suspended particles are replaced by fresh alloy particles. This is partly responsible for the frequently encountered poor reproducibility of the amount of codeposited nickel alloy particles when Watts bath is adopted.

In other baths such as Weisberg bath, sulfamate bath etc. there exists the same story as in Watts bath.

This invention according to an earnest investigation of the inventors is for the purpose of overcoming the above-mentioned drawbacks in a plating method for preparation of an electrode suitable for an electrolysis of an alkali halide solution.

According to this invention, an excellent electrode with an initial low hydrogen overvoltage and with good durability in an electrolysis of an alkali halide solution or water is obtained even at the low concentration of nickel alloy particles in the solution.

In case of cobalt system, the above description meets by replacing nickel with cobalt.

Particles containing a metal selected from Ni or Co are dispersed in said plating bath. The kind and size of the particles are described above.

When an alloy made of the first metal of Ni or Co the second metal of Al, Zn, Mg, Si, Sb or Sn is used, as the particles it is preferable to treat the particles with an alkali metal hydroxide as described below. The alloy is preferably the unleached Raney nickel or Raney cobalt as described.

The particles can be made of the first metal only or the particles of an alloy of the first metal and second metal from which a part of the second metal is removed. In such case, it is unnecessary to treat the particles with an alkali metal hydroxide. Such alloy can be a leached Raney nickel or Raney cobalt.

In such case, it is preferable to form partially oxide layer on the surface of the particles to stabilize the surface from the viewpoint of handling. In particular, a commercially available stabilized Raney nickel or Raney cobalt can be used.

The oxide coating on the particles may be removed under reducing the oxide with hydrogen generated when the electrode is used as a cathode in an electrolysis of an aqueous solution of an alkali metal halide or water. The oxide coating may be removed by reducing it, before using the electrode (for example, heating the electrode in hydrogen).

A concentration of the particles in the bath is preferably in a range of 1 g/liter to 200 g/liter from the viewpoint of improvement of bonding the particles on the surface of the electrode. A temperature condition in the dispersion coating method is preferably in a range of 20° C. to 80° C. and a current density is preferably in a range of 1 A/dm$^2$ to 20 A/dm$^2$.

It is possible to add a desired additive for reducing strain or a desired additive for improving a codeposition in the plating bath.

It is also possible to heat or to repeat a nickel plating after the dispersion coating in order to improve the bonding property between the particles and the metal layer.

As described, when the middle layer is formed between the electrode substrate and the metal layer containing the particles, the electrode substance is firstly coated by a nickel plating, a cobalt plating or a copper plating and then, the metal layer containing the particles is formed on the middle layer by a dispersion coating method.

In the formation of the middle layer, various plating bath can be used.

Thus, the electrode having the particles coated through the metal layer on the electrode substrate can be obtained.

Thus, if desired, the resulting electrode is treated with an alkali metal hydroxide (for example, an aqueous solution of an alkali metal hydroxide) to remove at least part of the metal component other than Ni and Co in the alloy of the particles.

In the treatment, a concentration of an aqueous solution of an alkali metal hydroxide as NaOH is preferably in a range of 5 to 40 wt. % and a temperature is preferable at 50° C. to 150° C.

EXAMPLE 1

Powdery unleached Raney nickel alloy (Ni 50%; Al 50%; 200 mesh pass)(manufactured by Kawaken Fine Chemical Co. Ltd.). was dispersed into an all nickel chloride bath ($NiCl_2.6H_2O$ 300 g/liter; $H_3BO_3$ 38 g/liter, 90 g $Cl^-$/l solution), in the concentration of 20 g/liter and a nickel plate was used as an anode and an iron plate (electrode substrate) was used as a cathode and a plating was carried out under a condition of a current density of 3 A/dm$^2$, pH of 2.0, at 55° C. for 30 minutes with mechanically stirring. As the result, a grayish black layer was formed on the iron plate. The nickel plated layer had a thickness of about 80$\mu$ and the content of Ni-Al alloy particles in the nickel plated layer was about 35 wt. %. Oxygen concentration of the plated particle was measured as follows.

The plated layer was peeled off from the substrate and an amount of oxygen (A $\mu$ g) in said layer was measured with an oxygen concentration device. On the other hand, an amount of oxygen (B $\mu$ g) only in plated nickel namely, nickel matrix was measured with the same device. Thus, the oxygen concentration (X ppm) of the plated particle is $$X(\text{ppm}) = \frac{A - B}{\text{total weight of said particles (g)}}$$

Oxygen concentration of the sample according to the above-mentioned procedure was 47 ppm and almost all of this oxygen was in the interior of the particles. The surface of the electrode was treated with 20% NaOH at 80° C. for 1 hour by the leaching to dissolve aluminum component. The resulting plated iron plate had an electrical double layer capacity of 18000 $\mu$F/cm$^2$.

The electrical double layer capacity was measured as follows. A test piece and a platinum plate coated with platinum black having a specific surface area of 100 times of the surface area of the test piece were immersed in an aqueous solution of NaOH of 40 wt. % at 25° C. forming a pair of electrode. The cell-impedance was measured with the Kohlarausch bridge and then the electrical double layer capacity of the test piece was calculated from it.

An electrode potential of the plated iron plate as a cathode versus a saturated calomel electrode as a reference electrode was measured in 40 wt. % aqueous solution of NaOH at 90° C. and 20 A/dm$^2$.

As the result, a hydrogen overvoltage was 60 m V under the condition of 40% NaOH solution 90° C.

EXAMPLE 2

An electrode was prepared according to Example 1 except that unleached Raney nickel alloy (Ni 50%; Al 50%; 200 mesh pass) was dispersed into an all nickel chloride bath ($NiCl_2.6H_2O$ 300 g/liter $H_3BO_3$ 38 g/liter, 90 g$Cl^-$/l solution) in the concentration of 40 g/liter and a codeposition operation was carried out 10 hours after the preparation of the bath with mechanically stirring.

The nickel plated layer had a thickness of about 100μ and the content of Ni-Al alloy particles in the nickel plated layer was about 45 wt.%. The oxygen concentration of the plated particles according to the same method as in Example 1 was 15 ppm, and almost all of this was in the interior of the particles.

The resulting plated iron plate had an electrical double layer capacity of 23000 $\mu F/cm^2$. The hydrogen overvoltage was 50 m V under the same condition as in Example 1.

EXAMPLE 3

Powdery unleached Raney nickel alloy (Ni 50%; Al 50%; 200 mesh pass)(manufactured by Kawaken Fine Chemical Co. Ltd.) was dispersed into high nickel chloride bath ($NiSO_4.6H_2O$ 200 g/liter; $NiCl_2.6H_2O$ 175 g/liter; $H_3BO_3$ 40 g/liter, 52.5 $gCl^-/l$ solution), in the concentration of 25 g/liter and a nickel plate was used as an anode and an iron plate (electrode substrate) was used as a cathode and a plating was carried out under the condition of a current density of 3 $A/dm^2$, pH of 2 at 55° C. for 30 minutes. As the results a grayish black layer was formed on the iron plate. The oxygen concentration of the plated particles according to the same method as in Example 1 was 78 ppm and almost all of this oxygen was in the interior of the particles. The nickel plated layer had a thickness of about 100μ and a content of Ni-Al alloy particles in the nickel plated layer was about 35 wt. %.

In accordance with the process in Example 1, the aluminum component was dissolved. The resulting electrode had an electrical double layer capacity of 15000 $\mu F/cm^2$ and showed a hydrogen overvoltage of 70 m V under the condition shown in Example 1.

EXAMPLE 4

An electrode was prepared according to Example 3 except that unleached nickel-zinc alloy (Ni 50%; Zn 50%; 200 mesh pass) was dispersed into a high nickel chloride bath ($NiSO_4.6H_2O$ 200 g/liter, $NiCl_2.6H_2O$ 175 g/liter, $H_3BO_3$ 40 g/liter, 52.5 $gCl^-/l$ solution), in the concentration of 45 g/liter. The oxygen concentration of the plated particles according to the same method as in Example 1 was 73 ppm, and almost all of this oxygen was in the interior of the particles. The nickel plated layer had a thickness of about 90μ and the content of Ni-Zn alloy particles in the nickel plated layer was about 45 wt. %.

An electrical double layer capacity was 21000 $\mu F/cm^2$ and the hydrogen overvoltage was 55 m V under the same condition as in Example 1.

EXAMPLE 5

Powdery unleached Raney nickel alloy (Ni 50%; Al 50%; 200 mesh pass) (manufactured by Kawaken Fine Chemical Co. Ltd.) was dispersed into a nickel chloride-nickel acetate bath ($NiCl_2.6H_2O$ 135 g/liter; $Ni(CH_3COO)_2.4H_2O$ 105 g/liter 40.5 $gCl^-/l$ solution), in the concentration of 20 g/liter and a nickel plate was used as an anode and an iron plate (electrode substrate) was used as a cathode and a plating was carried out under the condition of a current density of 3 $A/dm^2$, pH of 2.0 at 55° C. for 30 minutes. As a result, a grayish black layer was formed on the iron plate. The oxygen concentration of the plated particles according to the same method as in Example 1 was 92 ppm and almost all of this oxygen was in the interior of the particles. The nickel plated layer had a thickness of about 70μ and the content of Ni-Al alloy particles in the nickel plated layer was about 35 wt. %.

In accordance with the process in Example 1, the aluminum component was dissolved. The resulting electrode had an electrical double layer capacity of 15000 $\mu F/cm^2$ and showed a hydrogen overvoltage of 70 m V under the condition shown in Example 1.

EXAMPLE 6

An electrode was prepared according to Example 5 except that unleached nickel-silicon alloy (Ni 50%; Si 50%; 200 mesh pass) was dispersed into a nickel chloride-nickel acetate bath ($NiCl_2.6H_2O$ 135 g/liter, $Ni(CH_3COO)_2.4H_2O$ 105 g/liter, 40.5 $gCl^-/l$ solution), in the concentration of 50 g/liter, the content of Ni-Si alloy particles in the nickel plated layer was about 45 wt. % and the resulting electrode was not treated with caustic soda solution according to Example 1. The oxygen concentration of the plated particles according to the same method as in Example 1 was 100 ppm and almost all of this oxygen was in the interior of the particles.

An electrical double layer capacity was 21000 $\mu F/cm^2$ and a hydrogen overvoltage was 55 m V under the same condition as in Example 1.

EXAMPLE 7

Figure 3:
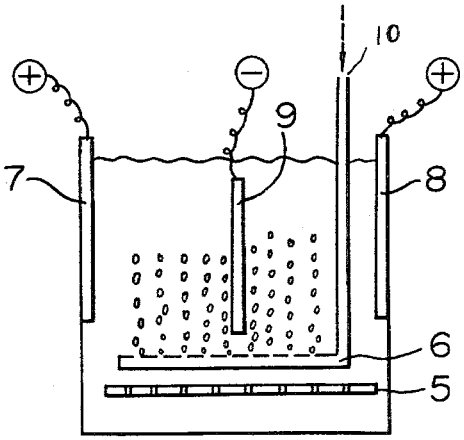
FIG. 3 is a diagram of an electrolytic cell used in the process of Example 7.

Powdery unleached Raney nickel (Ni 50 wt. %; Al 50 wt. %) (manufactured by Kawaken Fine Chemical Co. Ltd.) was dispersed into a nickel chloride bath ($NiCl.6H_2O$ 300 g/liter; $H_3BO_3$ 38 g/liter 90 $gCl^-/l$ solution), at the concentration of 20 g/liter. The resulting dispersion having pH of 2.0 was charged into an electrical plating vessel in FIG. 3 wherein a perforated plate (5) was vertically moved at the lower part of the vessel and nitrogen gas was downwardly injected through a bubbler (6) and a plate (9) for plating was disposed between a pair of nickel electrodes (7), (8) having substantially same area. The perforated plate was moved at a stroke of about 20% to the height of the bath at 100 Hz/min. and the nitrogen gas was injected at a rate of 10 liter/min. $dm^2$ of the area of the bottom of the vessel. The plate (9) for coating as a cathode (an electrode substrate) was an iron expanded metal. The plating was carried out at 40° C. under a current density of 3 $A/dm^2$ for 1 hour to form a grayish black layer wherein a thickness of the plated nickel layer was about 105μ and the content of the unleached Raney nickel particles in the plated nickel layer was 35 wt. %. The plated nickel layer was uniform in whole parts. The oxygen concentration of the plated particles according to the same method as in Example 1 was 48 ppm and almost all of this oxygen was in the interior of the particles.

The resulting plate was treated with an alkali metal hydroxide in the same way as describe in Example 1 and was cut. Hydrogen overvoltages of the cut pieces were measured to find 50 m V at all of the cut pieces under the same condition as in Example 1.

An electrical double layer capacity of the plated layer was 25000 $\mu F/cm^2$.

EXAMPLE 8

Powdery unleached Raney nickel (Ni 50 wt. %; Al 50 wt. %) was dispersed into a nickel chloride bath ($NiCl.6H_2O$ 300 g/liter; $H_3BO_3$ 38 g/liter, 90 $gCl^-/l$ solution), in the concentration of 20 g/liter and the dispersion was fed into a plating vessel (11) shown in FIG. 4 wherein an iron plate (12) for plating was disposed between a pair of nickel anodes (13), (14) having substantially same area and a plating was carried out under recycling the dispersion having pH of 2.0 at 55° C. at a linear flow rate of 70 cm/sec. in the vessel by a pump under a current density of 3 A/dm$^2$ for 30 minutes. A grayish black layer was formed and a thickness of the plated nickel layer was about 80$\mu$ and a ratio of the unleached Raney nickel in the nickel layer was about 35 wt. %. The plated nickel layer was uniform in whole parts. The oxygen concentration of the plated particles according to the same method as in Example 1 was 55 ppm and almost all of this oxygen was in the interior of the particles.

The resulting plate was treated with an alkali metal hydroxide in the same way as described in Example 1 and was cut and hydrgen overvoltages of the cut pieces were measured to find 60 m V at all of the cut pieces under the same condition as in Example 1. An electrical double layer capacity of the plated layer was 18000 $\mu$F/cm$^2$.

EXAMPLE 9

Figure 4:
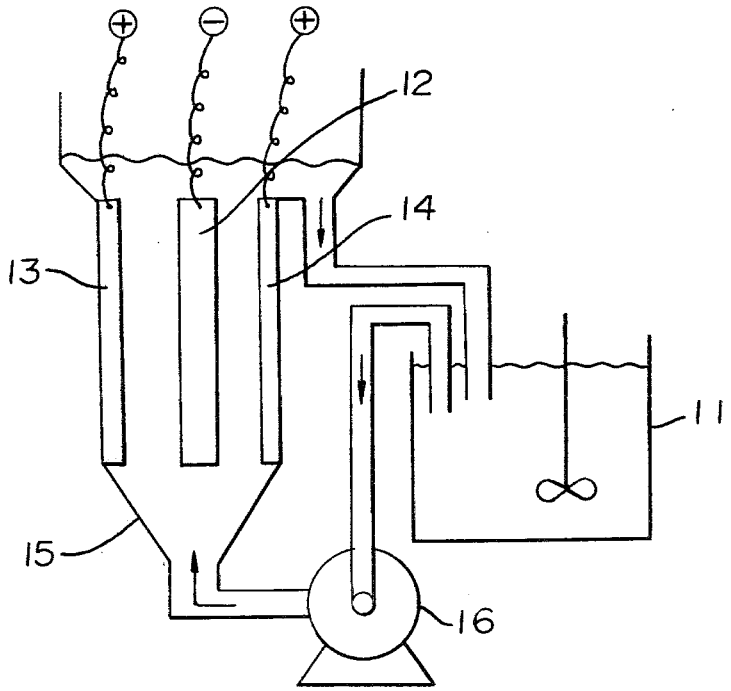
FIG. 4 is a diagram of an electrolytic cell used in the process of Example 8.

In the apparatus shown in FIG. 4 (same with Example 8), the powdery unleached Raney nickel of Example 8 was dispersed into the high nickel chloride bath ($NiSO_4.6H_2O$ 200 g/liter; $NiCl_2.6H_2O$ 175 g/liter; $H_3BO_3$ 40 g/liter, 52.5 gCl$^-$/l solution) in the concentration of 20 g/liter and the dispersion having pH of 1.5 was recycled by a pump and a plating was carried out at 50° C. at a linear flow rate of 85 cm/sec. in the vessel under a current density of 3 A/dm$^2$ for 30 minutes on an iron plate (a cathode). A grayish black layer was formed a thickness of the plated nickel layer was about 70$\mu$ and a ratio of the unleached Raney nickel in the nickel layer was about 35 wt. %. The plated nickel layer was uniform in whole parts. The oxgyen concentration of the plated particles according to the same method as in Example 1 was 70 ppm and almost all of this oxygen was in the interior of the particles.

The resulting plate was treated with an alkali metal hydroxide in the same way as described in Example 1 and was cut and hydrogen overvoltages of the cut pieces were measured to find 70 m V at all of the cut pieces under the same condition as in Example 1.

An electrical double layer capacity of the plated layer was 15000 $\mu$F/cm$^2$.

EXAMPLE 10

Powdery Co-Al alloy (Co 50 wt. %; Al 50 wt. %; average particle size of 30$\mu$) was dispersed into a cobalt bath ($CoSO_4.7H_2O$ 330 g/liter; $H_3BO_3$ 30 g/liter; $CoCl_2.6H_2O$ 150 g/liter, pH 2.0 at 35° C. 50 gCl$^-$/l solution) in the concentration of 50 g/liter and a cobalt plate was used as an anode and a copper plate (electrode substrate) was used as a cathode and a plating was carried out at 35° C. for 60 minutes to plate a cobalt layer on the copper electrode substrate. According to a microscopic observation, it was found that many fine pores are formed on the surface of the layer. The oxygen concentration of the plated particles according to the same method as in Example 1 was 82 ppm and almost all of this oxygen was in the interior of the particles. The surface of the electrode was trated with 20% NaOH at 80° C. for 1 hour by the leaching to dissolve aluminum component. The resulting electrode had an electrical double layer capacity of 15000 $\mu$F/cm$^2$. The electrode was used as the cathode in 40 wt. % aqueous solution of NaOH at 90° C. under a current density of 20 A/dm$^2$, which gave a hydrogen overvoltage was 65 m V under the condition of Example 1.

EXAMPLE 11

Powdery Co-Al alloy (Co 50 wt. %; Al 50 wt. %; average particle size of 30$\mu$) was dispersed into a cobalt bath ($CoSO_4.7H_2O$ 330 g/liter, $H_3BO_3$ 30 g/liter; $CoCl_2.6H_2O$ 250 g/liter, pH 1.5 at 35+ C., 75 gCl$^-$/l solution) in the concentration of 50 g/liter and a cobalt plate was used as an anode and a copper plate (electrode substrate) was used as a cathode and a plating was carried out at 35° C. for 50 minutes to plate a cobalt layer on the copper electrode substrate. According to a microscopic observation, it was found that many fine pores are formed on the surface of the layer.

The oxygen concentration of the plated particles according to the same method as in Example 1 was 62 ppm and almost all of this oxygen was in the interior of the particles.

The surface of the electrode was treated with 20% NaOH at 80° C. for 1 hour by the leaching to dissolve aluminum component. The resulting electrode had an electrical double layer capacity of 22,000 $\mu$F/cm$^2$. The electrode of used as the cathode in 40 wt. % aqueous solution of NaOH at 90° C. under a current density of 20 A/dm$^2$ which gave a hydrogen overvoltage was 60 m V under the condition of Example 1.

REFERENCE 1

Powdery unleached Raney nickel (Ni 50%; Al 50%; average particle size of 30$\mu$) (manufactured by Kawaken Fine Chemical Co. Ltd.) was dispersed into Watts bath ($NiSO_4.7H_2O$; 300 g/liter; $NiCl_2.6H_2O$ 45 g/liter; $H_2BO_3$ 30 g/liter, 13.5 gCl$^-$/l solution) in the concentration of 100 g/liter and a nickel plate was used as an anode and a iron plate (electrode substrate) was used as a cathode and a plating on the iron plate was carried out under a condition of a current density of 3 A/dm$^2$, pH of 4.0 at 55° C. for 30 minutes. The content of Ni-Al alloy particles in the nickel plated layer was about 35 wt. %.

The oxygen concentration of the plated particles according to the method as in Example 1 was 380 ppm and almost all of this oxygen was on the particle surface.

The surface of the electrode was treated with caustic soda according to Example 1.

The resulting plated iron plate had an electrical double layer capacity of 8000 $\mu$F/cm$^2$. A hydrogen overvoltage was 120 m V under the same condition as in Example 1.

REFERENCE 2

An electrode was prepared according to Reference 1 except that powdery unleached Raney nickel (Ni 50%; Al 50%, 200 mesh pass) was dispersed into Watts bath ($NiSO_4.7H_2O$: 300 g/liter, $NiCl_2.6H_2O$: 45 g/liter, $H_2BO_3$: 30 g/liter, 13.5 gCl$^-$/l solution) in the concentration of 200 g/liter. The content of Ni-Al alloy particles in the nickel plated layer was about 45 wt. %. The oxygen concentration of the plated particles according to the same method as in Example 1 was 430 ppm, and almost all of this oxygen was on the particle surface.

An electrical double layer capacity of the plated layer was 10,000 $\mu$F/cm$^2$ and a hydrogen overvoltage was 120 m V under the same condition as in Example 1.

REFERENCE 3

The powdery unleached Raney nickel described in Example 1 was dispersed into a sulfamate bath (nickel sulfamate 300 g/liter; $NiCl_2.6H_2O$ 6 g/liter; $H_3BO_3$ 40 g/liter; pH 4.0, 1.8 $gCl^-/l$ solution) in the concentration of 100 g/liter and a plating was carried out for 1 hour and the oxygen concentration of the plated particles according to the same method as in Example 1 was 480 ppm and almost all of this oxygen was on the particle surface. An aluminum component was dissolved by treating in 20% NaOH at 80° C. for 1 hour. An electrode having an electrical double layer capacity of 7000 $\mu F/cm^2$ was obtained and gave a hydrogen overvoltage of 130 m V under the condition described in Example 1.

The content of Ni-Al alloy particles in the plated layer was about 35 wt. %.

Test:

An electrode was prepared according to Reference 1 except that a codeposition procedure was carried out 10 hours after the preparation of the bath.

The nickel plated layer had a thickness of about 25μ and the content of Ni-Al alloy particles in the nickel plated layer was about 5 wt. %. The resulting plated iron plate had an electrical double layer capacity of 800 $\mu F/cm^2$. The hydrogen overvoltage was 320 m V under the same condition as in Example 1. Because of too high value of initial hydrogen overvoltage, the measurement of oxygen concentration was not carried out.

The characteristics other than those mentioned in the Examples and References were measured as follows.

1. Adhesion strength of the codeposited layer. According to the procedure described in Japan Industrial Standard (JIS) A 1452, 250 g of SiC particles of 46 mesh were dropped onto the codeposited layer of the sample from the height of 76 cm. The weight decrease of the codeposited layer was measured before durability test and the result is shown in Table 1.

2. Durability of hydrogen overvoltage in chloro-alkali electrolysis.

Brine was electrolysed for 500 days under the following conditions.

Anode:
DSA
Cathode:
each of the samples shown in above Examples and References.
Diaphragm:
Membrane obtained by hydrolyzing copolymer of tetrafluoro ethylene and $CF_2{=}CFO{-}(CF_2)_3COOCH_3$
Cell temperature:
90° C.
Current density:
20 $A/dm^2$
Catholyte:
40% NaOH solution The initial and final values of the hydrogen overvoltage was measured and shown in Table 1. But, only in case of Reference 4, because of too high initial hydrogen overvoltage the adhesion strength test and duration test were not carried out.

TABLE 1

| | | Decrease in weight of codeposited layer (mg) | Hydrogen overvoltage Initial (mV) | Hydrogen overvoltage Final (mV) |
|---|---|---|---|---|
| Exp. | 1 | 10 | 60 | 50 |
| | 2 | 18 | 50 | 50 |
| | 3 | 12 | 70 | 70 |
| | 4 | 20 | 55 | 55 |
| | 5 | 11 | 70 | 70 |
| | 6 | 18 | 55 | 55 |
| | 7 | 5 | 50 | 50 |
| | 8 | 10 | 60 | 60 |
| | 9 | 12 | 70 | 70 |
| | 10 | 12 | 65 | 65 |
| | 11 | 10 | 60 | 60 |
| Ref. | 1 | 75 | 120 | 180 |
| | 2 | 140 | 100 | 200 |
| | 3 | 90 | 130 | 200 |
| | 4 | — | 320 | — |

What is claimed is:

1. In an electrode which comprises a metal layer comprising at least nickel or cobalt on an electrode substrate, the improvement comprising: said metal layer comprising partially exposed metal particles comprising at least Raney nickel alloy or Raney cobalt alloy, the surfaces of which have an oxygen concentration of 47 to 150 ppm, and said metal layer being formed by codepositing said metal and said particles from a dispersion containing metal particles comprising at least Raney nickel alloy or Raney cobalt alloy, at least 30 g/l of $Cl^-$ ions, and Co ions or Ni ions and having a pH of about 1.5 to about 2.

2. The electrode according to claim 1, wherein the ratio of said Raney nickel alloy or Raney cobalt alloy particles to the total metal of said metal layer including said particles is within the range of 25 to 60 wt.%.

3. The electrode according to claim 1, wherein said particles are an alloy comprising nickel or cobalt as the first metal and at least one metal selected from the group consisting of aluminum, zinc, magnesium, silicon, antimony and tin as the second metal.

4. The electrode according to claim 1, wherein the electrical double layer capacity of the surface of said electrode is greater than 1000 $\mu F/cm^2$.

5. The electrode according to claim 1, wherein said electrode further comprises a middle layer comprising at least one metal selected from the group consisting of nickel, cobalt, silver and copper between said electrode substrate and the plated metal layer containing the metal particles.

6. The electrode according to claim 3, wherein said electrode is formed by removing at least one of said metals constituting said second metal from the alloy before electrolysis of an aqueous solution of an alkali metal chloride or water by a diaphragm process or an ion exchange membrane process.

7. The electrode according to claim 1, which is obtained by immersing an anode and a cathode as electrode substrates in a dispersion accommodated in a plating vessel which provides a vertically moving perforated plate and gas evolving unit in the lower portion of said vessel, moving said plate vertically and bubbling a gas through said gas evolving unit and simultaneously transmitting direct current between said anode and cathode, thereby codepositing metal particles and the metal onto said cathode surface.

8. The electrode according to claim 1 or 2, wherein said metal layer has a thickness of 20 to 200 μm and a porosity of 35 to 85% and said metal particles exposed in said metal layer have a diameter of 0.1 to 100 μm.

9. The electrode according to claim 1, 2 or 7, wherein said metal particles are present in said dispersion in an amount of 1 to 200 g/liter and said codeposition is carried out at 20° to 80° C. at a current density of 1 to 20 $A/dm^2$.

* * * * *